US009758732B1

(12) United States Patent
Saha

(10) Patent No.: US 9,758,732 B1
(45) Date of Patent: Sep. 12, 2017

(54) REMOVAL OF POISONOUS METALLOIDS (AS, SB, BI) FROM CRUDE OIL

(71) Applicant: Anuj K Saha, Martinez, GA (US)

(72) Inventor: Anuj K Saha, Martinez, GA (US)

( * ) Notice: Subject to any disclaimer, the term of this patent is extended or adjusted under 35 U.S.C. 154(b) by 0 days.

(21) Appl. No.: 14/863,834

(22) Filed: Sep. 24, 2015

(51) Int. Cl.

| | |
|---|---|
| ***C10G 17/00*** | (2006.01) |
| ***C10G 17/04*** | (2006.01) |
| ***C10G 29/10*** | (2006.01) |
| ***C10G 29/06*** | (2006.01) |

(52) U.S. Cl.
CPC ..... *C10G 17/04* (2013.01); *C10G 29/06* (2013.01); *C10G 29/10* (2013.01)

(58) Field of Classification Search
CPC ..... C10G 17/02; C10G 17/04; C10G 17/06; C10G 17/07; C10G 29/06; C10G 29/10
USPC ..... 208/251 R, 252
See application file for complete search history.

(56) References Cited

U.S. PATENT DOCUMENTS

| | | | | |
|---|---|---|---|---|
| 2,778,777 A * | 1/1957 | Powell | C10G 17/06 | 204/567 |
| 4,773,988 A | 9/1988 | Delaney | | |
| 4,915,818 A * | 4/1990 | Yan | C10G 21/08 | 208/251 R |
| 5,290,338 A * | 3/1994 | Anderson | C01G 30/00 | 423/87 |
| 2010/0000910 A1* | 1/2010 | Gallup | C10G 31/08 | 208/251 R |
| 2012/0067786 A1* | 3/2012 | Gallup | C10G 17/07 | 208/252 |

OTHER PUBLICATIONS

Anawar et al, Mobilization of arsenic from subsurface sediments by effect of bicarbonate ions in groundwater, 54 Chemosphere 753 (Feb. 2004).*

John H Duffus, "Heavy Metals"—Meaning Less Term, Pur Appl. Chem., 2002, pp. 793-807, vol. 74, No. 5, International Union of Pure and Applied Chemistry.

Geoff Rayner-Canham and Tina Overton, Descriptive Inorganic Chemistry, 2010, pp. 148-151, W.H.Freeman and Company, New York, USA.

* cited by examiner

*Primary Examiner* — Prem C Singh
*Assistant Examiner* — Brandi M Doyle
(74) *Attorney, Agent, or Firm* — RB Consulting Inc.; James Carson

(57) ABSTRACT

The removal of poisonous metalloids from crude oil is a method of removing naturally occurring arsenic (As), antimony (Sb), and bismuth (Bi) from crude oil before the crude oil is processed through a refinery. The removal of poisonous metalloids from crude oil entails forming an emulsion comprising the crude oil and an inorganic salt or mineral acid solution prepared by recirculation and agitation. The agitation of the emulsion causes arsenic (As), antimony (Sb), and bismuth (Bi) containing compounds to dissolve in the inorganic salt or mineral acid solution. The crude oil is separated from the inorganic salt or mineral acid solution by settling. The treated crude oil has a poisonous metalloid concentration of less than 1 ppm making it acceptable for oil refining operations. Optionally, any inorganic salt or mineral acid solution remaining in the crude oil after separation can be removed using a silica gel dryer.

17 Claims, 1 Drawing Sheet

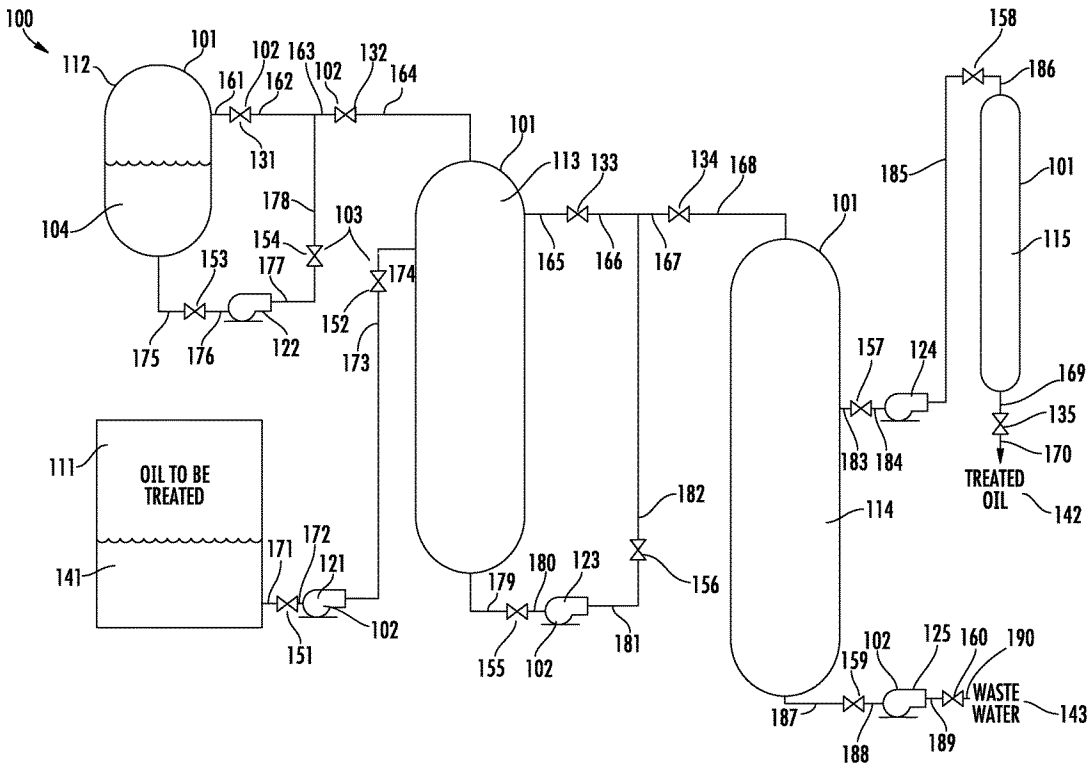
TREATED OIL
WASTE WATER
OIL TO BE TREATED

REMOVAL OF POISONOUS METALLOIDS (AS, SB, BI) FROM CRUDE OIL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of non-Newtonian liquid hydrocarbon purification and separation, more specifically, an accessory configured for use in removing poisonous metalloids from crude oil.

Depending on the origin of the crude oil in the earth's crust, crude oil can contain poisonous metalloids such as arsenic (As), antimony (Sb) and bismuth (Bi). Of these three metalloids, arsenic is more common and is found in the crude oil pumped from fractured shale deposits. Arsenic contaminated crude oil is also found in crude oil deposits that have co-mingled with coal seams in the earth's crust. Many coal seams contain arsenic and at times may contain antimony and bismuth. All the three metalloids belong to Group VA (Column 15) in the periodic table of elements. They all have toxic effects on human body.

If not removed below the level of 1 ppm, the crude oil containing the metalloids builds up on the catalyst bed and poisons the catalyst during refining operations. The poisoned catalyst bed must be replaced with a new bed to maintain the product quality. Losing a catalyst bed before its due time causes a financial hardship to refining operations and affects the bottom line.

Clearly, the refiners need an inexpensive and easy to use process to remove the poison metalloids from the crude oil.

SUMMARY OF INVENTION

The presented disclosure addresses this need.

The removal of poisonous metalloids from crude oil is a method of removing the naturally occurring arsenic (As), antimony (Sb), and bismuth (Bi) from crude oil before the crude oil is processed through a refinery. Specifically, the removal of poisonous metalloids from crude oil discloses a way of forming an emulsion comprising the crude oil and an inorganic salt or mineral acid solution of inorganic constituents. The agitation of the emulsion causes arsenic (As), antimony (Sb), and bismuth (Bi) containing compounds to dissolve out of the oil matrix into the inorganic salt or mineral acid solution. When allowed to settle for a certain length of time, the crude oil and the inorganic salt or mineral acid solution forms two clearly distinct phases. The metalloid free crude oil can then be easily separated from the inorganic salt or mineral acid solution by decantation or pump out. Optionally, any aqueous solution remaining in the crude oil after separation can be removed using an optional silica gel dryer. The spent inorganic salt or mineral acid solution containing the metalloids can be discharged directly into waste water treatment systems, or POTW (publically owned treatment works). Alternatively, the waste discharge can also be mixed into concrete and shipped as a stabilized solid to a sanitary landfill with minimal environmental risk.

These together with additional objects, features and advantages of the removal of poisonous metalloids from crude oil will be readily apparent to those of ordinary skill in the art upon reading the following detailed description of the presently preferred, but nonetheless illustrative, embodiments when taken in conjunction with the accompanying drawings.

In this respect, before explaining the current embodiments of the removal of poisonous metalloids from crude oil in detail, it is to be understood that the removal of poisonous metalloids from crude oil is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the removal of poisonous metalloids from crude oil.

It is therefore important that the claims be regarded as including such equivalent construction insofar as they do not depart from the spirit and scope of the removal of poisonous metalloids from crude oil. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 1 is a schematic of an embodiment of the disclosure.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to potential embodiments of the disclosure, which are illustrated in FIG. 1.

The thermodynamic conditions for the treatment process are ambient pressure and temperature. The process does not use any heat nor does it give away any heat. It is neither exothermic nor endothermic in nature. The separation of the three contaminants is thought to be based on selective dissolution and is thought not to involve any chemical reaction.

It is explicitly recognized in this disclosure that as an element bismuth is commonly considered a post transition metal and not a metalloid. However, it is also recognized that some allotropes of bismuth do have properties resembling metalloids. Because the classification of bismuth as a post transition metal or metalloid is not relevant to the inventive essence of this disclosure, this disclosure will assume that Bismuth is appropriately classified as a metalloid. This assumption is made to simplify and to improve the clarity of this disclosure.

The removal of poisonous metalloids from crude oil 100 (hereinafter invention) comprises a plurality of storage tanks 101, a plurality of pumps 102, a plurality of valves 103, and an inorganic salt or mineral acid solution 104. The poisonous metalloid is removed from the untreated crude oil 141 by mixing and creating an emulsion of the untreated crude oil 141 and an inorganic salt or mineral acid solution 104. Because the poisonous metalloid is more soluble in the inorganic salt or mineral acid solution 104 than in the untreated crude oil 141, the poisonous metalloid will dissolve into and remain in the inorganic salt or mineral acid solution 104 after the emulsion separates back into its treated crude oil 142 and inorganic salt or mineral acid solution 104 components. The purpose of the plurality of storage tanks 101, the plurality of pumps 102, and the plurality of valves 103, is to facilitate and control the storage, mixing, and separation of the treated crude oil 142 and the inorganic salt or mineral acid solution 104.

A mixing or agitation time of 15 to 30 minutes is adequate to form an emulsion between the untreated crude oil 141 and the inorganic salt or mineral acid solution 104. Upon 15 to 30 minutes of passive settling of the emulsion, the treated crude oil 142 and the spent inorganic salt or mineral acid solution 143 forms two clear separate phases allowing easy separation from one another.

The purpose of the plurality of storage tanks 101 is to facilitate and control the storage and mixing, of the untreated crude oil 141 and the inorganic salt or mineral acid solution 104 and the and separation of the treated crude oil 142 and the spent inorganic salt or mineral acid solution 143. The plurality of storage tanks 101 further comprises an untreated oil tank 111, a solution tank 112, a mixing tank 113, a separation tank 114, and an optional silica gel dryer 115. The untreated oil tank 111 is used to contain the untreated crude oil 141 that will be processed by the invention 100. The solution tank 112 is used to contain the inorganic salt or mineral acid solution 104 that is used to process the untreated crude oil 141. The mixing tank 113 is used to create and agitate the emulsion that is formed between the untreated crude oil 141 and the inorganic salt or mineral acid solution 104. The separation tank 114 is a vertical storage tank that is used to store the emulsion of the untreated crude oil 141 and the inorganic salt or mineral acid solution 104 while the emulsion separates into two clearly distinct phases. The optional silica gel dryer 115 is used to remove any extraneous inorganic salt or mineral acid solution 104 that may be remaining in the treated crude oil 142 after separation.

The plurality of pumps 102 comprises a source transfer pump 121, a solution transfer pump 122, a mixing pump 123, an oil extraction pump 124, and a solution discharge pump 125. The source transfer pump 121 is used to pump the untreated crude oil 141 from the untreated oil tank 111 to the mixing tank 113. The solution transfer pump 122 is used to: 1) recirculate the inorganic salt or mineral acid solution 104 within the solution tank 112; and, 2) to pump the inorganic salt or mineral acid solution 104 stored in the solution tank 112 into the mixing tank 113. The mixing pump 123 is a high flow, low head pump that is used to: 1) recirculate the untreated crude oil 141 and inorganic salt or mineral acid solution 104 mixture to create and maintain an emulsion for a predetermined period of time; and, 2) to pump the untreated crude oil 141 and inorganic salt or mineral acid solution 104 mixture from the mixing tank 113 to the separation tank 114 after the intimate mixing of the untreated crude oil 141 and the inorganic salt or mineral acid solution 104 is completed. The mixing pump 123 is sized to at least pump 15% of the volume of the mixing tank 113 per minute back into the mixing tank 113. This high flow volume will agitate the untreated crude oil 141 and the inorganic salt or mineral acid solution 104 to create and maintain the emulsion. The oil extraction pump 124 is used to pump the treated crude oil 142 after it is separated out of emulsion matrix. In the first potential embodiment of the disclosure, the oil extraction pump 124 pumps the treated crude oil 142 into the optional silica gel dryer 115. In a second potential embodiment of the disclosure, an optional silica gel dryer 115 is not used. In the second potential embodiment of the disclosure, since no further treatment of the crude oil is required, the oil extraction pump 124 is used to remove the treated crude oil 142 from the separation tank 114 and pump the treated crude oil 142 to a storage location. The solution discharge pump 125 is used to remove the spent inorganic salt or mineral acid solution 143 discharge from the separation tank 114. The spent inorganic salt or mineral acid solution 143 discharge is pumped to a storage location to await disposition. Disposition of the spent inorganic salt or mineral acid solution 143 discharge is discussed elsewhere in this disclosure.

The plurality of valves 103 comprises a solution tank recirculation valve 131, a mixing tank inlet valve 132, a mixing tank recirculation valve 133, a separation tank inlet valve 134, and a treated oil discharge valve 135. The plurality of valves 103 further comprises a plurality of pump isolation valves that can be used to isolate each of the plurality of pumps 102 for maintenance and control purposes. The plurality of pump isolation valves further comprises the first pump isolation valve 151, the second pump isolation valve 152, the third pump isolation valve 153, the fourth pump isolation valve 154, the fifth pump isolation valve 155, the sixth pump isolation valve 156, the seventh pump isolation valve 157, the eighth pump isolation valve 158, the ninth pump isolation valve 159, and the tenth pump isolation valve 160. The solution tank recirculation valve 131 further comprises a first end 161 and a second end 162. The mixing tank inlet valve 132 further comprises a third end 163 and a fourth end 164. The mixing tank recirculation valve 133 further comprises a fifth end 165 and a sixth end 166. The separation tank inlet valve 134 further comprises a seventh end 167 and an eighth end 168. The treated oil discharge valve 135 further comprises a ninth end 169 and a tenth end 170. The first pump isolation valve 151 further comprises an eleventh end 171 and a twelfth end 172. The second pump isolation valve 152 further comprises a thirteenth end 173 and a fourteenth end 174. The third pump isolation valve 153 further comprises a fifteenth end 175 and a sixteenth end 176. The fourth pump isolation valve 154 further comprises a seventeenth end 177 and an eighteenth end 178. The fifth pump isolation valve 155 further comprises a nineteenth end 179 and a twentieth end 180. The sixth pump isolation valve 156 further comprises a twenty first end 181 and a twenty second end 182. The seventh pump isolation valve 157 further comprises a twenty third end 183 and a twenty fourth end 184. The eighth pump isolation valve 158 further comprises a twenty fifth end 185 and a twenty sixth end 186. The ninth pump isolation valve 159 further comprises a twenty seventh end 187 and a twenty eighth end 188. The tenth pump isolation valve 160 further comprises a twenty ninth end 189 and a thirtieth end 190.

As shown in FIG. 1, the first potential embodiment of the disclosure is assembled and operates as follows:

The eleventh end 171 of the first pump isolation valve 151 is connected to the untreated oil tank 111. The twelfth end 172 of the first pump isolation valve 151 is connected to the input of the source transfer pump 121. The thirteenth end 173 of the second pump isolation valve 152 is connected to the output of the source transfer pump 121. The fourteenth end 174 of the second pump isolation valve 152 is connected to as an input to the mixing tank 113.

The fifteenth end 175 of the third pump isolation valve 153 is connected to the output of the solution tank 112. The sixteenth end 176 of the third pump isolation valve 153 is connected to the input of the solution transfer pump 122. The seventeenth end 177 of the fourth pump isolation valve 154 is connected to the output of the solution transfer pump 122. The eighteenth end 178 is connected to the second end 162 of the solution tank recirculation valve 131 and to the third end 163 of the mixing tank inlet valve 132. The first end 161 of the solution tank recirculation valve 131 is connected as an input into the solution tank 112. The fourth end 164 of the mixing tank inlet valve 132 is connected as an input into the mixing tank 113. When the solution transfer pump 122 is in operation, both the third pump isolation valve 153 and the fourth pump isolation valve 154 are open. If the solution tank recirculation valve 131 is open the solution transfer pump 122 will recirculate the inorganic salt or mineral acid solution 104 through the solution tank 112. If the mixing tank inlet valve 132 is open then the solution transfer pump 122 will pump the inorganic salt or mineral acid solution 104 into the mixing tank 113. The solution tank recirculation valve 131 and the mixing tank inlet valve 132 should never be open at the same time during normal operation The nineteenth end 179 of the fifth pump isolation valve 155 is connected as an output to the mixing tank 113. The twentieth end 180 of the fifth pump isolation valve 155 is connected to the input of the mixing pump 123. The twenty first end 181 of the sixth pump isolation valve 156 is connected to the output of the mixing pump 123. The twenty second end 182 of the sixth pump isolation valve 156 is connected to the sixth end 166 of the mixing tank recirculation valve 133 and to the seventh end 167 of the separation tank inlet valve 134. The fifth end 165 of the mixing tank recirculation valve 133 is connected as an input to the mixing tank 113. The eighth end 168 of the separation tank inlet valve 134 is connected as an input to the separation tank 114. When the mixing pump 123 is in operation, both the fifth pump isolation valve 155 and the sixth pump isolation valve 156 are open. If the mixing tank recirculation valve 133 is open the mixing pump 123 will recirculate the untreated crude oil 141 and inorganic salt or mineral acid solution 104 emulsion through the solution tank 112. If the separation tank inlet valve 134 is open then the mixing pump 123 will pump the untreated crude oil 141 and inorganic salt or mineral acid solution 104 emulsion into the separation tank 114. The mixing tank recirculation valve 133 and the separation tank inlet valve 134 should never be open at the same time during normal operation.

The twenty third end 183 of the seventh pump isolation valve 157 is connected to an output from the separation tank 114. The positioning of the twenty third end 183 of the seventh pump isolation valve 157 will depend on the anticipated elevation where the untreated crude oil 141 and the spent inorganic salt or mineral acid solution 143 emulsion will separate. The twenty third end 183 of the seventh pump isolation valve 157 will be positioned such that it will only remove untreated (or treated) crude oil 141 from the separation tank 114. The twenty fourth end 184 of the seventh pump isolation valve 157 is connected to the input of the oil extraction pump 124. The twenty fifth end 185 of the eighth pump isolation valve 158 is connected to the output of the oil extraction pump 124. The twenty sixth end 186 of the eighth pump isolation valve 158 is connected to the input of the optional silica gel dryer 115. In the second potential embodiment of the disclosure, the twenty sixth end 186 of the eighth pump isolation valve 158 is connected directly to a storage tank designated to store treated crude oil 142. When the oil extraction pump 124 is in operation, both the seventh pump isolation valve 157 and the eight pump isolation valve 158 are open. Depending on the potential embodiment of the disclosure, the purpose of the oil extraction pump 124 is to pump oil from the separation tank 114 to the optional silica gel dryer 115 or to a final storage tank for treated crude oil 142.

The twenty seventh end 187 of the ninth pump isolation valve 159 is attached to an output of the separation tank 114. The twenty seventh end 187 of the ninth pump isolation valve 159 is connected to the bottom of the separation tank 114. The twenty eighth end 188 of the ninth pump isolation valve 159 is connected to the input of the solution discharge pump 125. The twenty ninth end 189 of the tenth pump isolation valve 160 is connected to the output of the solution discharge pump 125. The thirtieth end of the tenth pump isolation valve 160 is used to draw the spent inorganic salt or mineral acid solution 143, which is now waste water discharge, out of the system. When the solution discharge pump 125 is in operation, both the ninth pump isolation valve 159 and the tenth pump isolation valve 160 are open. The purpose of the solution discharge pump 125 is to pump the spent inorganic salt or mineral acid solution 143 discharge to a final storage location to await disposal. Methods to dispose of the spent inorganic salt or mineral acid solution 143 discharge are discussed elsewhere in this disclosure.

The inorganic salt or mineral acid solution 104 is mixture of water and an inorganic salt or an acid. Suitable inorganic salts include, but are not limited to, sodium sulfide ($Na_2S$) and sodium bicarbonate, or baking soda ($NaHCO_3$). Suitable acids include, but are not limited to, strong mineral acids such as nitric acid, sulfuric acid or hydrochloric acid. Experimental data shows that: 1) a 1% solution (by weight) of sodium sulfide mixed in equal volume with untreated crude oil 141 will reduce arsenic content in untreated crude oil 141 from 22 ppm to 0.22 ppm; 2) a 1% solution (by weight) of sodium bicarbonate mixed in equal volume with untreated crude oil 141 will reduce arsenic content in untreated crude oil 141 from 22 ppm to 0.41 ppm; and 3) a 0.5% solution (by weight) of sulfuric acid mixed in equal volume with untreated crude oil 141 will reduce arsenic content in untreated crude oil 141 from 22 ppm to 0.87 ppm. These results are well below the oil refinery threshold for acceptable arsenic levels of 1 ppm.

The results shown above are well below the industry threshold limit for acceptable Arsenic limit of 1 ppm. The use of a 1% inorganic salt solution in the above data is meant to provide an illustration for the technical feasibility of the treatment process. The process can use an inorganic salt solution concentration in the range of 0.5% to 5% (by weight) and is capable of treating Arsenic and/or Antimony content in the raw crude oil far higher than 100 ppm and up to the level of 1000 ppm. It is to be noted further that the Arsenic present in the crude oil is most likely in the form of Tri or Pentavalent sulfide (As2S3 or As2S5). The high selectivity and affinity of sodium sulfide for capturing the Arsenic sulfides make the process preferred, robust and practical for field application.

The experimental data described above also demonstrate that arsenic, antimony, and bismuth can be removed from untreated crude oil 141 through the use of a dilute acid solution. It is important to note that the inorganic salt (Na2S or NaHCO3) solutions are not capable of removing Bismuth from the raw crude oil. Inorganic salt solutions can only remove Arsenic and Antimony from the crude oil. However, the dilute acid solutions can remove all the three contaminants (Arsenic, Antimony and Bismuth) from the untreated crude oil 141 matrix.

In instances where the initial concentrations of the poisonous metalloid in the untreated crude oil 141 are so high that the disclosed methods and apparatus cannot reduce the concentration of the poisonous metalloid to acceptable levels, the output of the first processing of the crude oil can be processed a second time using the disclosed methods and apparatus to further reduce the concentration of the poisonous metalloid.

As discussed above, the spent inorganic salt or mineral acid solution 143 discharge contains poisonous metalloids. However, the anticipated concentrations of the poisonous metalloids within the spent inorganic salt or mineral acid solution 143 discharge are low enough that the spent inorganic salt or mineral acid solution 143 discharge can be discharged directly into a waste water treatment system such as a POTW. If a waste water treatment system is not available or is not willing to accept the waste stream, it is recommended that the spent inorganic salt or mineral acid solution 143 discharge be used to create concrete blocks which can then be safely stored in a sanitary landfill.

To use the invention 100, the untreated crude oil 141 and the inorganic salt or mineral acid solution 104 are combined in the mixing tank 113 (in equal or unequal volumes). The mixing pump 123 is then used to rapidly recirculate the untreated crude oil 141 and the inorganic salt or mineral acid solution 104 through the mixing tank 113 in order to emulsify and agitate the untreated crude oil 141 and the inorganic salt or mineral acid solution 104. Once the emulsification and agitation is completed, the emulsion is pumped into the separation tank 114 where the untreated crude oil 141 and the inorganic salt or mineral acid solution 104 naturally separate. Once separated, the untreated crude oil 141 is drawn off the top portion of the separation tank 114 and is sent to an optional silica gel dryer 115 or a storage facility. The inorganic salt or mineral acid solution 104 discharge 143 is drawn off the bottom of the separation tank 114 and is disposed of appropriately.

The following definitions were used in this disclosure:

Emulsion: As used in this disclosure, an emulsion is a dispersion of droplets or micelles of a first liquid in a second liquid in which the first liquid and second liquid are not soluble or miscible with one another.

Micelle: As used in this disclosure, a micelle is an aggregation of molecules each having polar and non-polar regions.

Poisonous Metalloid: As used in this disclosure, a poisonous metalloid is a metalloid selected from Group VA (Column 15) of the Periodic Table of Elements including: arsenic (As), antimony (Sb) or Bismuth (Bi).

POTW: As used in this disclosure, POTW is an acronym of publicly owned treatment works for the treatment of waste water.

Raw Crude Oil: As used in this disclosure, raw crude oil is crude oil that has not been processed by a refinery.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions.

Treated Crude Oil: As used in this disclosure, treated crude oil is raw crude oil that has been processed through selective separation by the invention.

Untreated Crude Oil: As used in this disclosure, untreated crude oil is raw crude oil that has not been completely processed through separation by the invention.

Waste Discharge: As used in this disclosure, the waste discharge refers to the discharge of the spent inorganic salt or mineral acid solution containing the metalloids after the settling phase of the process.

With respect to the above description, it is to be realized that the optimum dimensional relationship for the various components of the invention described above and in FIG. 1 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A method for removing poisonous metalloids from raw crude oil wherein a first mixture is formed mixing a first quantity of untreated raw crude oil with a second quantity of treating solution;

wherein a pseudo (unstable) emulsion is formed by agitating the first mixture;

wherein the agitated first mixture is separated by gravity into a treated raw crude oil phase and a spent treating solution phase;

wherein the treating solution is selected from the group consisting of a dilute inorganic salt solution or a dilute mineral acid solution;

wherein the method for removing poisonous metalloids from raw crude oil removes poisonous metalloids from raw crude oil;

wherein the poisonous metalloid dissolves into the treating solution;

wherein the poisonous metalloid remains dissolved in the treating solution and does not form a precipitate;

wherein the poisonous metalloid remains in the spent treating solution;

wherein the level of poisonous metalloids remaining in the raw crude oil after treatment is below 1 part per million;

wherein the method for removing poisonous metalloids from raw crude oil occurs at ambient pressure;

wherein the method for removing poisonous metalloids from raw crude oil occurs at ambient temperature;

wherein the method for removing poisonous metalloids from raw crude oil is not exothermic;

wherein the method for removing poisonous metalloids from raw crude oil is not endothermic.

2. The method for removing poisonous metalloids from raw crude oil according to claim 1 wherein the poisonous metalloid is arsenic.

3. The method for removing poisonous metalloids from raw crude oil according to claim 2 wherein the treating solution comprises a sodium sulfide solution.

4. The method for removing poisonous metalloids from raw crude oil according to claim 3 wherein the concentration of sodium sulfide in the sodium sulfide solution is between 0.05% by weight and 5.0% by weight.

5. The method for removing poisonous metalloids from raw crude oil according to claim 2 wherein the treating solution comprises a dilute baking soda solution;

wherein the concentration of dilute baking soda in the dilute baking soda solution is between 0.05% by weight and 5.0% by weight.

6. The method for removing poisonous metalloids from raw crude oil according to claim 1 wherein the poisonous metalloid is antimony.

7. The method for removing poisonous metalloids from raw crude oil according to claim 6 wherein the treating solution comprises a sodium sulfide solution.

8. The method for removing poisonous metalloids from raw crude oil according to claim 7 wherein the concentration of sodium sulfide in the sodium sulfide solution is between 0.05% by weight and 5.0% by weight.

9. The method for removing poisonous metalloids from raw crude oil according to claim 6 wherein the treating solution comprises a dilute baking soda solution;

wherein the concentration of dilute baking soda in the dilute baking soda solution is between 0.05% by weight and 5.0% by weight.

10. The method for removing poisonous metalloids from raw crude oil according to claim 6 wherein the treating solution comprises a mineral acid solution;

wherein the concentration of mineral acid in the mineral acid solution is between 0.05% by weight and 5% by weight.

11. The method for removing poisonous metalloids from raw crude oil according to claim 1 wherein the poisonous metalloid is bismuth.

12. The method for removing poisonous metalloids from raw crude oil according to claim 11 wherein the treating solution comprises a mineral acid solution.

13. The method for removing poisonous metalloids from raw crude oil according to claim 12 wherein the concentration of mineral acid in the mineral acid solution is between 0.05% by weight and 5% by weight.

14. The method for removing poisonous metalloids from raw crude oil according to claim 1 wherein the removal of poisonous metalloids from crude oil further comprises a mixing tank, a mixing tank pump, untreated raw crude oil, and a treating solution;

wherein an first mixture is formed mixing a first quantity of untreated raw crude oil with a second quantity of treating solution;

wherein a pseudo (unstable) emulsion is formed by agitating the first mixture;

wherein untreated raw crude oil and the treating solution are mixed into the mixing tank;

wherein the first mixture is agitated by recirculating the first mixture with the mixing tank pump;

wherein the poisonous metalloid dissolves into the treating solution;

wherein the poisonous metalloid remains dissolved in the treating solution and does not form a precipitate;

wherein the poisonous metalloid remains in the spent treating solution;

wherein the method for removing poisonous metalloids from raw crude oil occurs at ambient pressure;

wherein the method for removing poisonous metalloids from raw crude oil occurs at ambient temperature;

wherein the method for removing poisonous metalloids from raw crude oil is not exothermic;

wherein the method for removing poisonous metalloids from raw crude oil is not endothermic.

15. The method for removing poisonous metalloids from raw crude oil according to claim 14 wherein the removal of poisonous metalloids from crude oil further comprises a separation tank;

wherein the mixing pump pumps the agitated first mixture into the separation tank;

wherein the agitated first mixture separates into treated crude oil and spent treating solution;

wherein the poisonous metalloid remains in the spent treating solution;

wherein the agitated first mixture is a pseudo (unstable) emulsion;

wherein the pseudo (unstable) emulsion does not require the use of a chemical reagent to cause a phase separation;

wherein the pseudo (unstable) emulsion does not require the application of energy from an external source to cause phase separation.

16. The method for removing poisonous metalloids from raw crude oil according to claim 15 wherein the poisonous metalloid is selected from the group consisting of arsenic, antimony or bismuth;

wherein the treating solution is selected from the group consisting of a dilute sodium sulfide solution, a dilute baking soda solution, or a dilute mineral acid solution.

17. The method for removing poisonous metalloids from raw crude oil according to claim 2 wherein the treating solution comprises a dilute mineral acid solution;

wherein the concentration of mineral acid in the mineral acid solution is between 0.05% by weight and 5% by weight.

* * * * *